United States Patent [19]

Hoffend et al.

[11] Patent Number: 4,600,677

[45] Date of Patent: Jul. 15, 1986

[54] ORGANOALKOXYSILANE CARRIER COATINGS

[75] Inventors: Thomas R. Hoffend, Webster; Joseph Mammino, Penfield, both of N.Y.

[73] Assignee: Xerox Corporation, Stamford, Conn.

[21] Appl. No.: 357,966

[22] Filed: Mar. 15, 1982

[51] Int. Cl.[4] ..... G03G 9/10; G03G 9/14

[52] U.S. Cl. ..... 430/108; 430/110; 430/126

[58] Field of Search ..... 430/108, 120, 121, 122, 430/123, 126

[56] References Cited

U.S. PATENT DOCUMENTS

| | | | |
|---|---|---|---|
| 3,526,533 | 9/1970 | Jacknow et al. . | |
| 3,650,814 | 3/1972 | Elder, Jr. . | |
| 3,833,366 | 9/1974 | Madrid et al. | 430/108 |
| 3,840,464 | 10/1974 | Van Engeland et al. | 430/108 |
| 3,944,705 | 3/1976 | Fujioka et al. | 428/331 |
| 4,039,331 | 8/1977 | Lee . | |
| 4,039,463 | 8/1977 | De Roo et al. | 430/108 |
| 4,043,929 | 8/1977 | Gibson et al. | 430/108 |
| 4,225,650 | 9/1980 | van Brederode et al. | 428/405 |
| 4,271,234 | 6/1981 | Schönafinger et al. | 428/405 |

FOREIGN PATENT DOCUMENTS

| | | | |
|---|---|---|---|
| 3113157 | 1/1982 | Fed. Rep. of Germany | 430/108 |
| 53-59432 | 5/1978 | Japan | 430/108 |
| 55-127569 | 10/1980 | Japan | 430/108 |

*Primary Examiner*—Roland E. Martin

*Attorney, Agent, or Firm*—E. O. Palazzo

[57] ABSTRACT

This invention is generally directed to electrostatographic carrier compositions comprised of a core, containing from about 0.004 weight percent to about 10 weight percent of a polymerized organoalkyoxysilane coating, wherein the monomers to be polymerized are selected from the group consisting of organoalkoxysilane monomers of the following formulas:

$$R-Si-(OR_1)_3,$$

and $$\begin{matrix} R_2 \diagdown \\ \quad Si-(OR_1)_2, \\ R_3 \diagup \end{matrix}$$

wherein $R_1$ is an alkyl group containing from about 1 to about 6 carbon atoms, and R, $R_2$, and $R_3$, are independently selected from the group consisting of alkyl groups, substituted alkyl groups, aromatic groups, and substituted aromatic groups. Developer compositions containing such carrier particles, and including therein toner resins, as well as methods of imaging utilizing such compositions are also embraced within the present invention.

22 Claims, No Drawings

ORGANOALKOXYSILANE CARRIER COATINGS

BACKGROUND OF THE INVENTION

This invention is generally directed to carrier compositions, and more specifically the present invention is directed to carrier compositions containing organoalkoxysilane coatings. Also embraced within the scope of the present invention are eleectrostatographic imaging systems utilizing developer compositions containing carrier particles coated with organoalkoxysilanes. Such developer compositions are unique since they can be utilized to develop electrostatic latent images of either a positive polarity or negative polarity, that is the toner compositions can be charged positively, or negatively, depending, for example, on the carrier coating. Further, the triboelectric properties of the carrier particles of the present invention can be controlled, and/or the conductivity of the carrier core surface can be varied as desired, depending for example, on the organoalkoxysilane employed.

The formation and development of electrostatic latent images on imaging surfaces, such as photoconductive materials is well-known. In one known method, electrostatic latent images, which are formed by placing a uniform electrostatic charge on a photoconductive insulating layer, followed by exposing the layer to a light and shadow image to dissipate the charge on the area of the layer exposed to the light, is developed by depositing on the photoconductive layer image toner particles. These particles are attracted to those areas of the photoconductive layer which retain a charge, thereby forming a toner image corresponding to the electrostatic latent image. Subsequently, the powder image may be transferred to a support surface such as paper, and the image may be permanently fused thereto, utilizing heat for example. Numerous different methods are known for applying the toner particles to the electrostatic latent image including cascade development, magnetic brush development, and the like. In these systems, generally, a developer composition comprised of relatively larger carrier particles, containing finely divided toner particles electrostatically clinging to their surface, is conveyed to and rolled or cascaded across the electrostatic latent image member. The composition of the toner particles is selected so as to possess a triboelectric polarity opposite to that of the carrier particles, thus, as the mixture cascades or rolls across the photoconductive member the toner particles are electrostatically deposited and secured to the charged portion of the latent image, and are not deposited on the uncharged or background portions of the image. Most of the toner particles which are accidentally deposited in the background area are removed by the rolling carrier particles, due primarily to the greater electrostatic attraction between the toner particles and carrier particles than between the toner particles and the discharge background. The carrier particles and unused toner particles can then be recycled.

Carrier particles may consist of numerous substances, either coated or uncoated, providing they have the appropriate triboelectric properties, and are of the appropriate conductivity. Thus, for most uses, the carrier materials employed, or the coatings thereon, should have a triboelectric value commensurate with the triboelectric value of the toner particles, so as to enable electrostatic adhesion of the toner particles to the carrier particles, and subsequent transfer of the toner particles from the carrier particles to the image on the photoreceptor surface. Additionally, the triboelectric properties of the carrier particles should be relatively uniform to allow the carrier particles to attract toner particles, and allow the deposition of such toner particles. Further, the materials employed as carrier particles should generally have an intermediate hardness, so as to avoid scratching of the photoconductive surface upon which the electrostatic image is initially placed, while at the same time being sufficiently hard to resist and withstand the forces to which the particles are subjected during recycling. Furthermore, the use of carrier particles that are comprised of brittle materials, which cause either flaking of the surface or particle breakup under the forces exerted on the particles during recycle, is known. Such flaking causes undesirable effects in that, for example, relatively small flake particles will eventually be transferred to the copy surface, thereby interferring with the deposited toner composition, and thus causing imperfections in the final copy image. Flaking of the carrier particles surface can also cause the resulting particles to have non-uniform triboelectric properties when the carrier particle is comprised of a core material different from the surface coating thereon, and this can result in an undesirable non-uniform pickup of toner particles by the carrier particles, and non-uniform deposition of the toner particles on the electrostatic latent image. Accordingly, the type of materials useful for carrier particles, or for coatings thereon, although possessing the appropriate triboelectric properties are limited because other physical properties which they possess may cause the undesirable results mentioned herein.

It has also been disclosed in the prior art that it would be highly desirable to alter the triboelectric properties of carrier cores to provide for the use of desirable toner compositions, while at the same time retaining the other desirable physical properties of the carrier particles. The alteration of the triboelectric properties of the carrier particles by applying a surface coating thereon has been found particularly useful since, with such coatings it is possible to alter the triboelectric properties of the carrier particles made from materials having desirable physical properties, while also utilizing materials previously not suitable as carrier particles. Thus, for example, carrier particles having desirable physical properties, with the exception of hardness can be coated with a material having the desired hardness, as well as other physical properties, rendering the resulting products useful as carrier particles.

Disclosed in U.S. Pat. No. 4,039,463, are electrostatographic developers comprising a carrier particle coated with a co-polymer of N-vinylcarbazole and trialkoxysilane and/or a triacetoxyvinyl silane. Apparently, such coatings alter the triboelectric properties of the carrier particles to accommodate them to desirable toner compositions, and further, such particles can be prepared in a simplified method. U.S. Pat. No. 4,039,331 contains a similar teaching, with the exception that the carrier particles have an outer layer thereon of a vinylpyridine, and an organosilicone carrier coating. While these improved carrier coatings have been found to be useful for certain applications, in some instances, the coatings are non-uniform in thickness, and the triboelectric properties, as well as the conductivity of the carrier particle varies over extended periods of time, thus resulting in carrier surfaces which degrade with use. Accordingly, there continues to be a need for carrier particles, as well as developer compositions containing such particles, wherein the coating thereon is substantially uniform in thickness, and where the surface conductivity of the carrier particles, as well as the triboelectric properties thereof can be controlled as desired, and wherein such properties remain constant over extended periods of time. Additionally, there continues to be a need for carrier particles wherein the surface thereof does not degrade with use.

SUMMARY OF THE INVENTION

It is an object of the present invention to provide carrier particles which overcome the above-noted disadvantages.

A further object of the present invention is the provision of carrier particles containing certain organoalkoxysilane coatings.

Yet a further object of the present invention resides in the provision of carrier particles containing certain organoalkoxysilane coatings, which coatings allow the preparation of carrier particles of a desired conductivity, and/or triboelectric value.

In yet a further object of the present invention there are provided developer compositions comprised of the coated carrier particles of the present invention, and toner particles, containing a toner resin, and pigments or colorants.

These and other objects of the present invention are accomplished by the provision of carrier particles comprised of a core having an diameter of from about 30 microns to about 1,000 microns, and containing a coating thereon in an amount of from about 0.004 weight percent to about 10 weight percent, which coating is selected from the group consisting of aliphatic and aromatic polymeric organoalkoxy silanes. The aliphatic and aromatic organoalkoxysilanes are obtained from the polymerization of organoalkoxysilanes selected from the group consisting of those silanes of the following formulas:

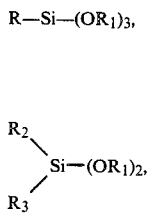

$$R-Si-(OR_1)_3,$$

and $$\begin{matrix} R_2 \\ \diagdown \\ Si-(OR_1)_2, \\ \diagup \\ R_3 \end{matrix}$$

or mixtures thereof, wherein $R_1$ is an alkyl group of from about 1 to about 6 carbon atoms, and R, $R_2$, and $R_3$, are independently selected from the group consisting of alkyl groups, substituted alkyl groups, aromatic groups, and substituted aromatic groups. The resulting organoalkoxysilane can be readily coated, absorbed and polymerized on the carrier core surface resulting in coated carrier particles possessing the desired triboelectric properties, and conductivity values as indicated hereinafter.

Illustrative examples of alkyl groups include those commonly known, however, in accordance with the present invention, such groups for R, $R_2$, and $R_3$ generally contain from about 1 to about 30 carbon atoms including methyl, ethyl, propyl, butyl, pentyl, heptyl, hexyl, octyl, nonyl, decyl, pentadecyl, eicosyl, and the like. The preferred R, $R_2$ and $R_3$ groups contain from about 1 to about 18 carbon atoms, up to octadecyl while the preferred alkyl groups for $R_1$, are methyl and ethyl.

Illustrative examples of aromatic substitutes for R, $R_2$ and $R_3$, include those containing from about 6 to about 30 carbon atoms, such as phenyl, napthyl, anthryl, and the like. The preferred aromatic radical is phenyl.

The alkyl and aromatic R, $R_2$, and $R_3$ groups can be substitued with numerous known substituents, including, for example, hydroxyl, carboxyl, carboxylic acid, carboxylic acid ester, anhydride, amide, aldehyde, ketone, ether, amine, nitro, halogen, quaternary ammonium, phosphonium, or sulphonium salts, such as, for example, the halogen salts, tosylate salts methyl sulfate salts, and the like, cyanide, isocyanate, urethane, urea, mercaptan, sulfide, sulfoxide, sulfone, sulfonic acid, and the like.

Illustrative examples of specific organosiloxane coatings which are subjected to polymerization, in order to form the polymeric organoalkoxysilane coatings of the present invention, include the following: octadecyl dimethyl[3-(trimethoxysilyl)-propyl] ammonium chloride; N-trimethoxy silyl propyl-N,N-dimethyl ammonium acetate; N-trimethoxy silyl propyl-N,N,N,-trimethyl ammonium chloride, amino butyltrimethoxy silane; 3-amino propyl triethoxy silane; 3-amino propyl trimethoxy silane; 1-trimethoxysilyl-2-(p-m-amino methyl)-phenyl ethane; N-2-amino ethyl-3-amino propyl trimethoxy silane; trimethoxysilyl propyl diethylene triamine; bis[3-(triethoxysilyl)propyl] amine; bis[-(triethoxysilyl)propyl] ethylene diamine; (N,N-diethyl-3-amino) propyl trimethoxy silane; N,N-dimethyl amino phenyl triethoxy silane; N-(trimethoxy silyl propyl) imidazole; N-(3-trimethoxy silyl propyl) morpholine; N,N-dimethyl-3-amino- propyl trimethoxy silane; methyl trimethoxy silane; methyl triethoxy silane; dimethyl dimethoxy silane; dimethyl diethoxy silane; ethyl trimethoxy silane; ethyl triethoxy silane; diethyl diethoxy silane; n-propyl triethoxy silane; butyl trimethoxy silane; amyl triethoxy silane; hexyl trimethoxy silane; octyl triethoxy silane; n-dodecyl triethoxy silane; octadecyl triethoxy silane; methyl dodecyl diethoxy silane; methyl octadecyl diethoxy silane; phenyl trimethoxy silane; phenyl triethoxy silane; benzyl triethoxy silane; diphenyl dimethoxy silane; diphenyl diethoxy silane; methyl phenyl dimethoxy silane; methyl phenyl diethoxy silane; 2-hydroxyethyl trimethoxy silane; 2-hydroxyethyl triethoxy silane; 2-carboxyethyl trimethoxy silane; 2-carboxyethyl triethoxy silane; (3,3,3-trifluoropropyl) trimethoxy silane; 2-chloroethyl trimethoxy silane; 2-chloroethyl triethoxy silane; chloromethyl methyl diethoxy silane; chloromethyl triethoxy silane; p-chlorophenyl triethoxy silane; 3-chloropropyl triethoxy silane; 3-hydroxypropyl triethoxy silane; 3-carboxy propyl triethoxy silane; 3-chloropropyl trimethoxy silane; 3-hydroxy propyl trimethoxy silane; 3-carboxy propyl trimethoxy silane; (γ-glycidoxy propyl) trimethoxy silane; (γ-glycidoxy propyl) methyldimethoxy silane; and 1-trimethoxy silyl-2-(p,m-chloromethyl) phenyl ethane; and the like.

The preferred organoalkoxysilanes that can be polymerized and that are useful as the carrier coatings of the present invention include phenyl trimethoxy silane; 3-chloropropyl trimethoxy silane; N,N-dimethyl-3-aminopropyltrimethoxy silane; N-trimethoxy silyl propyl-N,N,N-trimethyl ammonium chloride; (γ-glycidoxy propyl) trimethoxy silane; N-(trimethoxy silyl propyl) imidazole; octadecyl triethoxy silane; N-methyl amino propyl triethoxy silane; N-amyl triethoxysilane; and 3,3,3-trifluoropropyl trimethoxy silane.

The organoalkoxysilane monomers described hereinbefore can be polymerized by known methods under polymerization reaction conditions. In one embodiment, the carrier cores can be initially coated with the organosiloxane monomer followed by polymerization, while in another embodiment, the carrier core can be coated with the organoalkoxysilane monomer and polymerization simultaneously initiated in various systems including, for example, a fluidized bed system, a vibratub and the like. The polymerization reaction results generally in organoalkoxysilane polymers that can be linear or crosslinked depending on the functionality of the siloxane used.

The organoalkoxy silane material is applied to the carrier core in a sufficient amount so as to achieve the objectives of the present invention. This amount depends generally on the specific composition of the carrier core, the surface area of the carrier core, the percentage by weight of monomer applied, and the like.

Generally, however, the organoalkoxysilane monomer is applied in an amount so as to result in a final coating weight on the carrier core of from about 0.004 weight percent to about 10 weight percent, and preferably from about 0.4 weight percent to about 5 weight percent.

The triboelectric charge contained on the carrier particles can be varied within certain ranges, depending on, for example, the specific organoalkoxysilane material employed, the weight percentage of such material, and the like. Thus, for example, if a carrier triboelectric charge of from about 6 microcoulombs per gram to about 40 microcoulombs per gram is desired, there is applied to the carrier core the organoalkoxysilanes of the present invention in an amount sufficient so as to result in a carrier core coating in the range of from about 0.4 weight percent to about 3 weight percent, while if the carrier conductivity of a carrier core surface of from about $1\times10^{-8}$ (ohm-cm)$^{-1}$, to about $1\times10^{-12}$ (ohm-cm)$^{-1}$ is desired, from about 0.4 weight percent to about 6 weight percent of coating is utilized. Additionally, a very unique and important feature of the carrier particles of the present invention resides in the capability of such particles to vary the triboelectric charge polarity contained on the toner particles depending upon the organoalkoxysilane coating material utilized. Thus, for example, the toner particles can be charged to either a positive or negative triboelectric value, as illustrated, for example, in Table I, depending upon the specific organoalkoxysilane coating present. Additionally, for example, there can be employed the same carrier particles for the purpose of imparting a positive or negative triboelectric value to different toner compositions.

One important aspect of the organoalkoxysilane coatings of the present invention is the presence of alkoxysilane radicals in the structure of the organoalkoxysilane compounds. While it is not desired to be limited to theory, it is believed that these alkoxysilane radicals assist in facilitating the attachment of the organo functional siloxane structure to the surface of the carrier particles by the formation of a chemisorbed or physisorbed polymer on the carrier surface in accordance with the following schematic.

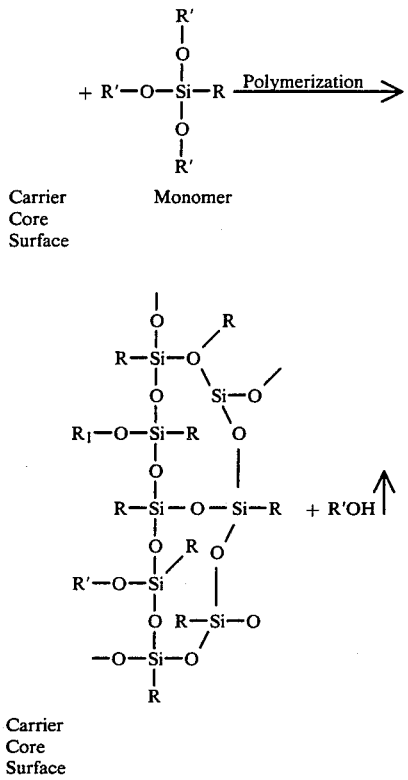

Accordingly, the appropriate organo functional structure can be selected such that the coating formed on the carrier core surface by the organoalkoxysilane compounds will develop a positive or negative charge. The organoalkoxysilane compounds can be mixed in various proportions, including mixtures of 50 percent of one monomer, and 50 percent of a second monomer, to achieve the carrier coatings properties desired. For example, unsubstituted alkane organoalkoxysilanes can be blended with the substituted alkyl organoalkoxysilanes to adjust the concentration of the substituted alkyl structure in the carrier coating, while producing an alkoxysilane coating over the entire surface of the carrier core.

Additionally, since the organoalkoxysilanes formed coatings on the carrier cores are stable over extended periods of time, such coatings can be employed as carrier core surface treatments for controlling carrier core surface conductivity. Furthermore, the organoalkoxysilane coatings can be overcoated by other materials presently known for carrier coating applications, including for example, utilization of overcoatings such as fluorocarbon polymers, for the preparation of negatively charged carriers.

Numerous different types of carrier cores can be coated with the organoalkoxysilanes of the present invention, including, for example, sodium chloride, aluminum, potassium chloride, glass, granular silicon, methylmethacrylate, silicon dioxide, iron, steel, ferrite, nickel, and mixtures thereof. The preferred carrier cores useful in the present invention include granular silicone, glass, methylmethacrylate, stainless steel, steel, ferrite, iron and nickel.

In another aspect of the present invention, the carrier cores can be treated by oxidation or phosphating, and further such carrier cores can have a primer applied thereto such as acrylates, which treatments allow for better adhesiveness between the carrier coating and the carrier core, controlled electrical properties, provision of tougher core surfaces, and the like.

The toner particles, (toner resin plus colorant or pigment), useful in the present invention includes numerous materials. Illustrative examples of the toner resins that may be employed include polyamides, epoxies, polyurethanes, vinyl resins, and polymeric esterification products of a dicarboxylic acid and a diol. Any suitable vinyl resin may be employed as the toner resin including homopolymers or copolymers of two or more vinyl monomers. Typical of such vinyl monomeric units include styrene, p-chlorostyrene, vinylnapthalene, ethylenically unsaturated mono-olefins such as ethylene, propylene, butylene, isobutylene, and the like, vinyl esters such as vinyl chloride, vinyl bromide, vinyl fluoride, vinyl acetate, vinyl benzoate, vinyl butyrate, and the like, esters of alpha methylene aliphatic monocarboxylic acids such as methyl acrylate, ethyl acrylate, and butyl acrylate, isobutyl acrylate, dodecyl acrylate, octyl acrylate, phenyl acrylate, methyl alphachloro acrylate, methylmethacrylate, ethylmethacrylate, butylmethacrylate, and the like.

Any suitable pigment or dye may be employed as the colorant for the toner resin particles, such materials being well-known and including for example, carbon black, nigrosine dye, calco oil blue, chrome yellow, duPont oil red, phthalocyanine blue, and mixtures thereof. The pigment or dye should be present in a quantity sufficient to render the toner resin highly colored so that it will form a clearly visible image on the imaging surface. Generally, carbon black is the preferred pigment. The pigment or colorant are preferably employed in an amount of from about 3 percent to about 20 percent by weight based on the total weight of the toner composition.

To form the developer compositions of the invention, there is usually employed about 96 to about 99 parts by weight of carrier particles to about 1 part of weight to about 4 parts by weight of toner particles There can also be included in the toner composition and/or developer composition, various charge enhancing additives for the purpose of imparting a positive polarity for example, to the toner resin. Examples of charge enhancing additives that can be utilized include known quaternary ammonium compounds, alkyl pyridinium halides, such as cetyl pyridinium chloride and the like. Generally, the charge enhancing additives, and in particular, the alkyl pyridinium halides, are present in an amount of from about 0.1 weight percent to about 10 weight percent, based on the weight of the resin particles. Additionally, there may be added to the toner resin other additive particles such as various stearates, including zinc stearate, silicone dioxide particles, such as those commercially available as Aerosil R972, and the like.

The preferred developer compositions of the present invention contain in addition to the organoalkoxysilane carrier particles, the following components:

Toner Composition A

1. Ninety-two percent by weight (92) of a styrene n-butylmethacrylate copolymer, containing 58 percent by weight of styrene, and 42 percent by weight of n-butyl methacrylate.
2. Six percent (6) by weight of Regal 330 carbon black.
3. Two (2) percent by weight of cetyl pyridinium chloride.

Toner Composition B 1. 89.7 percent by weight of a styrene n-butymethacrylate copolymer containing 58 percent by weight of styrene and 42 percent by weight of n-butyl methacrylate.
2. 10.3 percent by weight of Raven 5750 carbon black.

Toner Composition C 1. 88.5 weight percent of a polyester resin obtained from the reaction product of bis-phenol A, propylene oxide, and fumaric acid.
2. 11.5 percent by weight of Regal 330 carbon black.
3. Zinc stearate in an amount of 0.35 weight percent based on the weight of toner resin.
4. Aerosil R972 0.65 weight percent based on the weight of the toner resin.

Toner Composition D 1. 90 percent by weight of a styrene n-butylmethacrylate copolymer resin containing 58 percent by weight of styrene and 42 percent by weight of N-butyl methacrylate.
2. 10 percent by weight of Raven 5250 carbon black.
3. Zinc stearate in an amount of 0.75 percent by weight based on the weight of the toner resin.
4. Aerosil, R972, 0.65 weight percent based on the weight of the toner resin.

The developer compositions of the present invention, comprised of the coated carrier particles, and toner particles are useful for causing the development of electrostatic images, wherein the imaging surface, such as a photoreceptor member, has either been charged negatively or positively. The imaging method involves the formation of an electrostatic latent image on the omaging surface, followed by developing the image with the developer composition of the present invention, transferring the developed image to a suitable substrate, and permanently affixing the image thereto by heat or other known methods.

Examples of photoresponsive members that can be utilized for forming the electrostatic latent image thereon include selenium; alloys of selenium with arsenic, antimony, tellurium, and the like; organic photoreceptors including polyvinylcarbazole, and layered organic photoresponsive devices. Layered organic photoresponsive devices include those comprised of generating layers and transporting layers. In one embodiment, a preferred layered photoresponsive device is comprised of a substrate, a charge transport layer, and a charge generating layer as described in U.S. Pat. No. 4,265,990, the disclosure of which is totally incorporated herein by reference. Examples of charge generating layers include vanaldyl phthalocyanine or trigonal selenium, while examples of transport layers include the various diamines as disclosed in U.S. Pat. No. 4,265,990.

The invention will now be described in detail with respect to specific preferred embodiments, it being noted that these examples are intended to be illustrative only, and the invention is not intended to be limited to the conditions specified therein. All parts and percentages are by weight unless otherwise indicated.

EXAMPLE I

There were prepared carrier particles by coating with a vibratub coating apparatus, available from Vibraslide Corporation, Binghamton, N.Y., a spherical core of low surface area, about 300 meters$^2$/gram, consisting of 100/200 MESH steel beads, with a 15 weight percent solution of the silane material indicated in Table I, and ethanol, containing about 5 percent by weight of water, resulting after polymerization in a coating weight of 0.4 weight percent.

The coating process included distribution of the solution over the carrier surface, followed by evaporation of the solvent ethanol, and a partial curing of the silane, and subsequently post curing the coating in an oven at 125° C. for one hour. The carrier particles were placed in a tray for the coating curing process.

The triboelectric charge value, in microcoulombs per gram, for each of the organoalkoxy silane coated materials was measured by the known Faraday cage technique, utilizing the toner compositions indicated, previously described herein as toner compoitons A–D, and employing the mixing time shown in minutes with the following results.

TABLE I

| Carrier Coating To Be Polymerized | Toner Composition | Carrier Triboelectric Charge microcoulombs per gram (μc/g) of Toner 10 Min | 60 Min | 300 Min |
|---|---|---|---|---|
| 1. Phenyl Trimethoxy Silane | A | −2.6(1.0) | +1.3(.95) | +6.7(1.0) |
| | B | +5.3(1.0) | +10.5(.7) | +5.9(1.1) |
| 2. 3-Chloropropyl Trimethoxy Silane | A | −50.0(.8) | −13.9(1.3) | −0.9(1.0) |
| | B | −8.5(1.1) | −2.6(1.1) | −0.5(1.2) |
| 3. N,N—Dimethyl 3-Amino Propyltrimethoxy Silane | A | +2.9(1.1) | +5.6(.87) | +5.7(.87) |
| | B | +35.0(.7) | +25.0(.9) | +27.2(.8) |
| 4. N—Trimethoxy Silyl Propyl N,N,N—Trimethyl Ammonium Chloride | A | −12.5(1.0) | −8.2(1.1) | −3.3(.79) |
| | B | +44.8(1.2) | +4.8(.94) | +1.7(1.0) |
| 5. (γGlycidoxy Propyl)Trimethoxy Silane | A | −13.0(1.2) | −17.8(1.0) | −20.5(1.2) |
| | B | +14.1(1.0) | +12.9(1.0) | +10.9(.9) |
| 6. N—(Trimethoxy Silyl Propyl) Imidazole | A | −24.1(1.1) | −28.8(.8) | −20.3(1.0) |
| | B | +5.3(1.4) | +1.3(1.0) | 0(.9) |
| 7. Octadecyl Triethoxy Silane | A | −5.9(1.0) | +2.0(.9) | +10.5(.9) |
| | B | +6.9(.7) | +7.6(1.0) | +13.9(.7) |
| 8. N—Methyl Amino Propyl Triethoxy Silane | A | −21.61(1.1) | −26.4(.9) | −24.6(1.1) |
| | B | +36(0.8) | +31.3(0.8) | +25(1.1) |
| 9. n-Amyl Triethoxy Silane | A | −5.1(1.0) | −2.8(.7) | +4.4(.9) |
| | B | +4.0(.4) | +3.9(.9) | +8.3(.8) |
| 10. N,N—Dimethyl 3-Amino Propyltrimethoxy Silane | D | +27.2(1.0) | +8.1(1.2) | +11.1(.9) |
| 11. N,N—Dimethyl 3-Amino Propyltrimethoxy Silane | C | +25.3(1.2) | +18.5(0.9) | +16(0.7) |
| 12. N—(Trimethoxy Silyl Propyl) Imadazole | A | −11.6(2.9) | −12.8(2.5) | −14.3(2.5) |
| 13. N—Methyl Amino Propyl Triethoxy Silane | A | −12.4(2.8) | −12.2(2.9) | −10.7(2.5) |

Value in ( ) represents the percentage of toner concentration.

Similar triboelectric measurements were accomplished employing a carrier core having a high surface area, about 800 meters$^2$/gm, which cores are prepared by a water atomization process and are commercially available as Ancor steel, 80/150, from Hoeganaes Incorporated.

A developer composition was prepared by mixing 97 parts by weight of the coated carrier particles containing the polymerized coating octadecyl triethoxy silane, reference Table I, material 7, and 3 parts by weight of toner composition B. The developer composition was then applied to an electrostatic latent image formed on a positively charged arsenic selenium photoreceptor surface, containing 99.5 percent by weight of selenium, and 0.5 percent by weight of arsenic, followed by transferring the developed image to paper, and permanently affixing the image thereto utilizing heat. Copies of excellent resolution, and high quality with low background resulted.

A similar developer composition, with the exception that carrier particles containing a coating of polymerized N-methylamino propyltriethoxy silane and the toner composition A are utilized to develop images formed on a negatively charged layered photoresponsive device comprised of a substrate, overcoated with a generating layer of trigonal selenium, which in turn is overcoated with a transport layer of N,N'-diphenyl-N,N'-bis(3-methyl phenyl)1,1'-biphenyl-4,4'-diamine, reference U.S. Pat. No. 4,265,990. The developed image is transferred to paper and fixed thereto by heat. There is obtained final copies of high resolution and excellent quality with substantially no background deposits.

The carrier materials containing polymerized coatings of 4, 5, and 8 of Table I can be employed with toner resins of either a positive or negative polarity, which is a unique feature of the carrier particles of the present invention, while other carrier, for example, those containing polymerized coatings of 3, can be used primarily with negatively charged toner compositions.

EXAMPLE II

The procedure of Example I is repeated with the exception that there is employed as the organoalkoxy silane material (γglycidoxy propyl) trimethoxy silane material 5, and N-methylamino propyl triethoxy silane, material 8, in coating weight percentages of 0.15, 0.25, 0.6, 0.8 and 1.0. Substantially similar results are obtained.

Further when developer compositions containing the coated carrier particles of this example are employed in electrostatic latent imaging systems in accordance with Example I, substantially similar results are obtained.

Other modifications of the present invention will occur to those skilled in the art based upon a reading of the present disclosure and these modifications are intended to be included within the scope of this invention.

We claim:

1. An electrostatographic composition consisting essentially of toner particles and carrier particles, the carrier particles consisting essentially of a core, containing from about 0.004 weight percent to about 10 weight percent of a polymerized organoalkoxysilane coating, wherein the monomers to be polymerized are selected from the group consisting of organoalkoxy silane monomers of the following formulas:

$R—Si—(OR_1)_3$, and

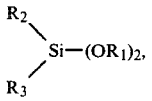

wherein $R_1$ is an alkyl group containing from about 1 to about 6 carbon atoms, R, $R_2$, and $R_3$, are independently selected from the group consisting of alkyl groups, substituted alkyl groups, aromatic groups, and substituted aromatic groups, and wherein the toner particles consisting essentially of resin particles and pigment particles, whereby there results carrier particles possessing positive or negative triboelectric values, which values are from about 5 microcoloumbs per gram to about 40 microcoloumbs per gram.

2. A developer composition in accordance with claim 1 wherein the pigment particles are carbon black, and the toner resin is comprised of a styrene n-butylmethacrylate copolymer resin.

3. A developer composition in accordance with claim 2 wherein the sytrene n-butylmethacrylate resin contains 58 percent by weight of styrene, and 42 percent by weight of n-butylmethacrylate.

4. A developer composition in accordance with claim 1 further including silicon dioxide particles and zinc stearate particles.

5. A developer composition in accordance with claim 1 further including charge enhancing additives.

6. A developer composition in accordance with claim 5 wherein the charge enhancing additives is an alkyl pyridinium halide.

7. A developer composition in accordance with claim 6 wherein the alkyl pyridinium halide is cetyl pyridinium chloride.

8. A developer composition in accordance with claim 1 wherein the organoalkoxy silane coating results from the polymerization of the monomers selected from the group consisting of phenyl trimethoxy silane, 3-chloropropyl trimethoxy silane; N,N-dimethyl-3-amino propyltrimethoxy silane; N-trimethoxy silyl propyl N,N,N-trimethyl ammonium chloride; (γ-glycidoxy propyl) trimethoxy silane; N-(trimethoxy silyl propy) imidazole; octadecyl triethosy silane; N-methyl amino propyl triethoxy silane and n-amyl triethoxy silane.

9. A developer composition in accordance with claim 1 wherein the rsin is a polyester resin.

10. A developer composition in accordance with claim 9 wherein the polyester resin is obtained from the reaction product of bisphenol-A triethylene glycol and fumaric acid.

11. A developer composition in accordance with claim 10 wherein the toner resin is charged positively, or charged negatively.

12. A method for developing electrostatic latent images consisting essentially of forming an electrostatic latent image on an imaging member, developing the image with a developer composition consisting essentially of toner particles and carrier particles, the carrier particles consisting essentially of a core, containing from about 0.004 weight percent to about 10 weight percent of a polymerized organoalkoxysilane coating, wherein the monomers to be polymerized are selected from the group consisting of organoalkoxy silane monomers of the following formulas:

$R—Si—(OR_1)_3$;

and

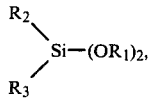

wherein $R_1$ is an alkyl group containing from about 1 to about 6 carbon atoms, R, $R_2$, and $R_3$, are independently selected from the group consisting of alkyl groups, substituted alkyl groups, aromatic groups, and substituted aromatic groups, whereby there results carrier particles possessing positive or negative negative triboelectric values, which values are from about 5 microcoloumbs per gram to about 40 microcoloumbs per gram and wherein the toner particles consisting essentially of resin particles and pigment particles, followed by transferring the image to a suitable substrate and permanently affixing the image thereto.

13. A method of imaging in accordance with claim 12 wherein the toner is comprised of a styrene n-butylmethacrylate resin, or polyester resin, and the carrier core is coated with an organoalkoxysilane resulting from the polymerization of monomers selected from the group consisting of phenyl trimethoxy silane, 3-chloropropyl trimethoxy silane; N,N-dimethyl-3-amino propyltrimethoxy silane; N-trimethoxy silyl propyl N,N,N-trimethyl ammonium chloride; (γ-glycidoxy propyl) trimethoxy silane; N-(trimethoxy silyl propy) imidazole; octadecyl triethosy silane; N-methyl amino propyl triethoxy silane and n-amyl triethoxy silane.

14. A method of imaging in accordance with claim 13 wherein the carrier core consists of steel.

15. A method of imaging in accordance with claim 13 wherein the toner resin is charged positively or negatively.

16. A method in accordance with claim 13 wherein the imaging member is comprised of amorphous selenium.

17. A method of imaging in accordance with claim 13 wherein the imaging member is comprised of amorphous selenium alloys.

18. A method of imaging in accordance with claim 13 wherein the imaging member is comprised of a substrate, a generating layer and a transport layer.

19. A method of imaging in accordance with claim 18 wherein the generating layer is trigonal selenium or vanadyl phthalocyanine.

20. A developer composition in accordance with claim 2 wherein the resin particles are present in an amount of from about 85 percent by weight to about 95 percent by weight, and the carbon black pigment particles are present in an amount of from about 5 percent by weight to about 15 percent by weight.

21. A developer composition in accordance with claim 9 wherein the polyester resin is present in the amount of from about 85 percent by weight to about 90 percent by weight, and the pigment particles are comprised of carbon black, in an amount of from about 10 percent by weight to about 15 percent by weight.

22. A developer composition in accordance with claim 21 wherein there is included therein as an additional component an alkyl pyridinium halide charge enhancing additive in an amount of from about 0.1 percent to about 10 percent by weight.

* * * * *